United States Patent [19]

Baumeister

[11] 4,415,840

[45] Nov. 15, 1983

[54] COMBINED FLASH TUBE AND QUENCH TUBE APPARATUS

[75] Inventor: Hans P. A. Baumeister, Churchville, N.Y.

[73] Assignee: Eastman Kodak Company, Rochester, N.Y.

[21] Appl. No.: 368,601

[22] Filed: Apr. 15, 1982

[51] Int. Cl.[3] ..... H05B 41/34

[52] U.S. Cl. ..... 315/323; 313/306; 313/594; 313/634; 315/232; 315/241 P; 315/334; 315/DIG. 1

[58] Field of Search ..... 313/1, 306, 581, 594, 313/601, 634; 315/36, 38, 229, 232, 241 P, 323–325, 334–337, 339, 340, DIG. 1

[56] References Cited

U.S. PATENT DOCUMENTS 4,004,189 1/1977 Cosco et al. ..... 315/335

*Primary Examiner*—Eugene R. LaRoche
*Attorney, Agent, or Firm*—D. P. Monteith

[57] ABSTRACT

Discharge apparatus comprises a xenon-filled glass envelope with a common cathode that divides the envelope into two separate gas-containing chambers. Respective anodes are provided in each chamber to cooperate with the common cathode. By placement of the cathode a closer distance to one of the anodes, the impedance of the discharge path between the more closely spaced electrodes is made lower than the impedance of the discharge path in the other chamber. To make the impedance even lower, the pressure of the gas between the closely spaced electrodes is made lower than the gas pressure between the other pair of electrodes. The discharge apparatus is particularly useful in quenchable electronic flash apparatus employing both a flash tube and a low-impedance quench tube.

6 Claims, 5 Drawing Figures

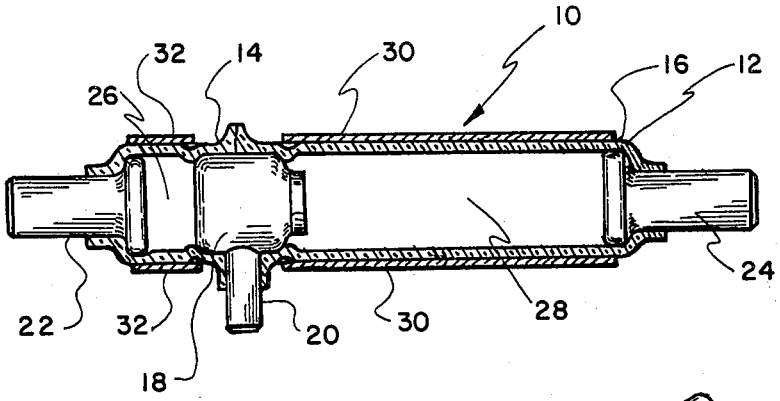
FIG. 1
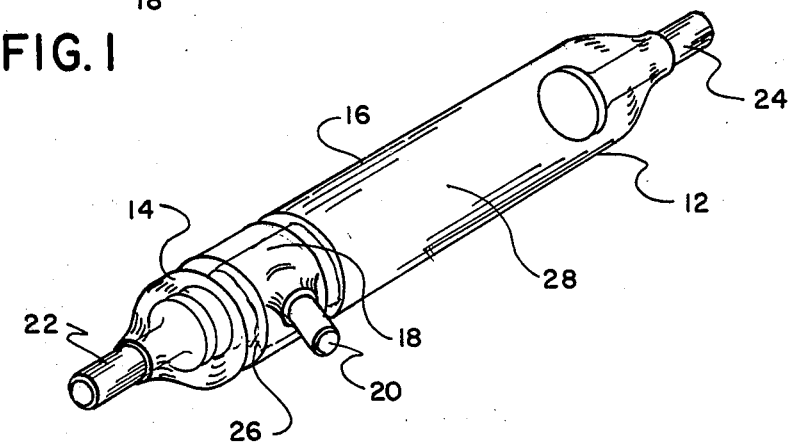
FIG. 2
FIG. 4
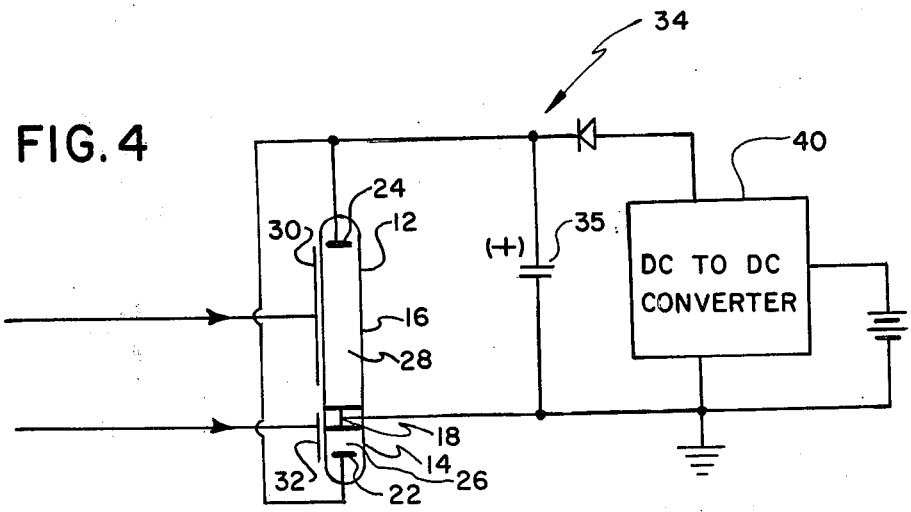

COMBINED FLASH TUBE AND QUENCH TUBE APPARATUS

BACKGROUND OF THE INVENTION

1. Field of the Invention

This invention relates to discharge devices of the types used as flash tubes and quench tubes in quenchable electronic strobe flash apparatus. More particularly, the invention relates to a discharge device which combines the operations of both a flash tube and a quench tube within a single compact structure.

2. Description of the Prior Art

As is well known in the electronic flash apparatus art, a quench tube is often employed to "quench" a flash tube after a predetermined amount of flash light has been produced. A flash tube and a quench tube have similar features. They each can comprise two spaced apart main current-carrying electrodes positioned at opposite ends of a hermetically sealed envelope which is filled with an inert ionizable rare gas, typically xenon, at a subatmospheric pressure. Both tubes must be capable of being triggered rapidly over the range of main electrode voltages used. Additionally, both tubes must be capable of handling relatively high currents.

On the other hand, to operate effectively the quench tube must meet certain criteria, which are different from those of a flash tube. Particularly, it must have a relatively low impedance compared to the flash tube. If the flash tube has a minimum impedance of typically 1 to 2 ohms, the quench tube should have an impedance of about 0.1 ohm.

In the prior art, the quench tube and flash tube are separate discharge devices. However, the use of two such separate discharge devices within a quenchable electronic strobe flash unit involves added problems with respect to cost, size, complexity, assembly, and the like.

SUMMARY OF THE INVENTION

According to the invention, a discharge device for use in quenchable electronic strobe flash apparatus of either the shunt-type or the energy-saving type, combines the operations of both a flash tube and quench tube within a unitary compact structure.

In a preferred embodiment, the discharge device includes a light-transmitting envelope having an ionizable gas therein, and a pair of end electrodes disposed respectively at the ends of said envelope. An intermediate electrode is disposed within said envelope between said end electrodes to form (1) a first enclosed chamber containing ionizable gas between one of said end electrodes and said intermediate electrode, and (2) a second enclosed chamber containing ionizable gas between the other of said end electrodes and said intermediate electrode, whereby two separate arc discharge paths are established respectively through said first and second chambers during operation of said discharge device when the polarity of said intermediate electrode is opposite the polarity of said end electrodes.

The invention, and its advantages, will become more apparent in the detailed description of preferred embodiments presented below.

DESCRIPTION OF THE DRAWINGS

In a detailed description of preferred embodiments of the invention presented below, reference is made to the accompanying drawings, in which:

FIG. 1 is a cross-sectional view of a preferred embodiment showing a flash tube and quench tube combined into a single unit, according to the invention;

FIG. 2 is a perspective view of the combined flash tube/quench tube apparatus of FIG. 1;

FIG. 4 is a schematic circuit diagram showing a combined flash tube/quench tube apparatus of the invention in a shunt-type quenchable electronic strobe flash unit.

DETAILED DESCRIPTION OF PREFERRED EMBODIMENTS

Figure 5:
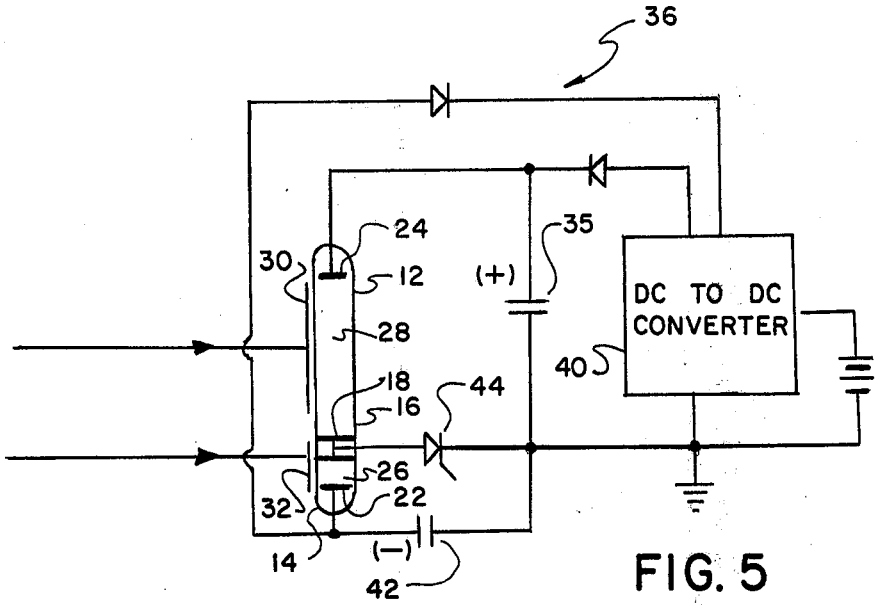
FIG. 5 is a schematic circuit diagram showing the combined flash tube/quench tube apparatus of the invention in an energy-saving or series-type quenchable electronic strobe flash unit.

Because discharge devices such as flash tubes and quench tubes for use in electronic strobe flash units are well known, the present description will be directed in particular to elements forming part of, or cooperating directly with, apparatus in accordance with the present invention. It is to be understood that elements not specifically shown or described may take various forms well known to those having skill in the art.

Referring now to FIGS. 1 and 2, an elongate glass enclosure 10 comprises a hermetically sealed, light-transmitting envelope 12. The envelope 12 consists of two glass tubes 14 and 16, which are of different lengths for a reason described below, and which are aligned end to end about a center electrode or cathode 18. The cathode has an electrically conductive metallic nipple 20 projecting transversely with respect to the longitudinal axis of the envelope 12.

To assemble the illustrative devices, the ends of the tubes 14 and 16 are first press fitted about their respective ends of the cathode 18. The tubes 14 and 16 are then fused together at about the middle of the cathode 18 by a suitable glass-to-glass fusing operation and are also sealed to cathode 18 and to nipple 20 by a suitable glass-to-metal fusing or sealing operation. The model DAP-700 Programmable Sealer manufactured by Scientific Sealing Technology of Downey, Calif. is suitable for fusing or sealing both glass-to-glass and glass-to-metal in an assembly operation of this type.

After the tubes 14 and 16 are joined together and sealed around the cathode 18, end electrodes on anodes 22 and 24 are disposed respectively at opposite ends of the envelope 12. The tubes 14 and 16 are evacuated using a suitable exhausting pump, then filled with an inert ionizable gas, such as xenon, at appropriate respective subatmospheric pressures. The anodes 22 and 24 are then sealed to respective ends of the envelope 12 by suitable glass-to-metal fusing equipment, such as the aforementioned model DAP-700 Programmable Sealer.

The cathode 18, the anode 22, and the tube 14 form an enclosed xenon-containing chamber 26. The cathode 18, the anode 24 and the tube 16 form an enclosed xenon-filled chamber 28. Because the tubes 14 and 16 are sealed around the cathode 18, the xenon in the chamber 28 is isolated from the xenon in the chamber 26.

For a reason described below, xenon contained within the chamber 26 is at a lower pressure than the xenon within the chamber 28. Accordingly, for ease of assembly, I prefer to initially fill both tubes with xenon at the low pressure desired for the chamber 26, then the anode 22 is sealed to the tube 14. Additional xenon is then injected into the tube 16 to raise the gas pressure, prior to sealing the anode 24 to the tube 16.

An external trigger wire or electrode 30 is mounted adjacent the exterior of the tube 16 between the cathode 18 and the anode 24. An external trigger ring electrode 32 surrounds the tube 14 between the cathode 18 and the anode 22.

Because the cathode 18 is disposed between the anodes 22 and 24, the cathode is common to both anodes. Also, because the cathode 18 is disposed within the envelope 12 so as to isolate the gas in the chamber 28 from the gas in the chamber 26, the application of a voltage trigger pulse to only one of the trigger electrodes causes ionizing of the gas only in the corresponding chamber. That is, an arc discharge occurs only through the chamber 26 when the trigger electrode 32 is energized, and an arc discharge occurs only through the chamber 28 when the trigger electrode 30 is energized. Thus, the two arc discharges may be produced sequentially.

Figure 3:
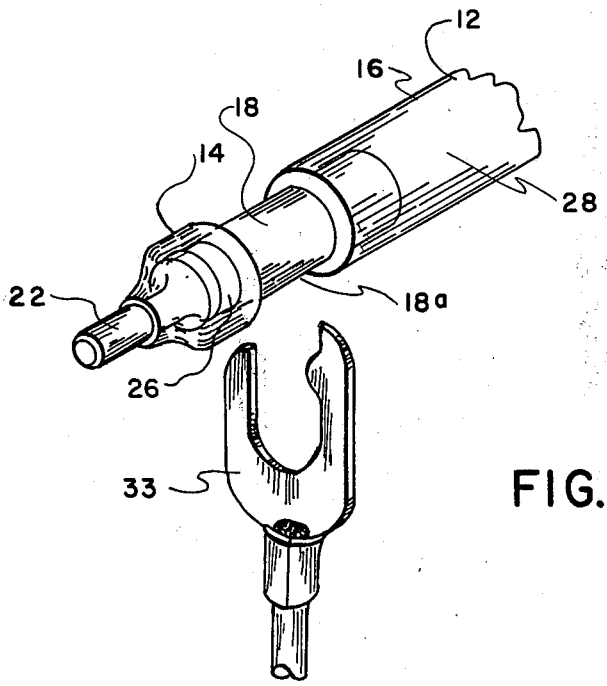
FIG. 3 is a perspective view of an alternate preferred embodiment of the invention.

An alternate preferred embodiment of apparatus constituting an invention is shown in FIG. 3. Elements functionally or structurally identical or similar to elements shown in FIGS. 1 and 2 are identified by like numerals.

The cathode 18 of the embodiment of FIG. 3 is cylindrically shaped. The diameter of the cathode 18 corresponds to the inner diameter of the tubes 14 and 16. Opposite ends of the cathode 18 are press fitted and sealed into their respective tubes 14 and 16. To assure a good seal against leakage of xenon gas past the cathode, I prefer to fuse each of the tubes 14 and 16 around opposite ends of the cathode 18.

As shown in FIG. 3, adjacent ends of the tubes 14 and 16 are not joined together, as is the case in the embodiment of FIG. 1. Thus, a central portion 18*a* of the cathode 18 is exposed. This facilitates electrically connecting the cathode 18 to external circuitry, e.g. by means of clip 33.

Similarly to the way in which the chambers 26 and 28 of the embodiment of FIGS. 1 and 2 are filled with xenon gas to obtain different pressures, in the embodiment of FIG. 3, the anode 22 preferably is sealed to the tube 14 prior to the anode 24 being sealed to the tube 12.

As described before, a quench tube of an electronic strobe flash apparatus must have a relatively low impedance compared to the impedance of the flash tube. To use the discharge apparatus constituting my invention in a quenchable electronic strobe flash unit wherein one portion of the enclosure 10 serves as a flash tube, and the other portion of the enclosure 10 serves as a quench tube, the impedance of the discharge path through the quench tube should be about 1/10 of, or less, the impedance of the discharge path through the flash tube. To provide such a low impedance for the quench tube, the quench tube has a lower gas pressure and a shorter interelectrode spacing than the gas pressure and interelectrode spacing for the flash tube. In a preferred embodiment, for a substantially constant internal diameter of the enclosure 10, the length of the discharge path through the quench tube is dimensioned to be 1/10 of, or less, the length of the discharge path through the flash tube, and the gas pressure of the quench tube is made somewhat less than the gas pressure of the flash tube. It will be understood by those having ordinary skill in the art that various combinations of gas pressure and electrode spacing may be used so long as the impedance of the quench tube is about no more than 1/10 of the impedance of the flash tube.

A discharge device which combines a quench tube and a flash tube into a single compact structure and which is constructed to meet these specifications is provided with a cathode 18 located within the enclosure 10 at a distance from the anode 22 of about ½ to 2 millimeters, and a distance from the anode 24 of about at least 9 millimeters. The gas in chamber 26 is filled with xenon gas to a pressure of about 500 millimeters Hg, while the chamber 28 is filled with xenon gas to a pressure of about 600 millimeters Hg. Thus, the tube 14, the chamber 16, the anode 22, and the cathode 18 form a quench tube, and the tube 16, the chamber 28, the anode 24, and the cathode 18 form a flash tube.

To handle the relatively high currents necessary for operating as a flash tube and as a quench tube, the electrodes 18, 22 and 24 may be made of a doped sintered tungsten, or, alternately, of molybdenum.

FIG. 4 illustrates the combined flash tube/quench tube apparatus of the invention in a shunt-type quenchable electronic strobe flash unit 34. As shown, the quench tube is electrically connected parallel with the flash tube. To operate the flash unit 34, a flash tube trigger voltage is applied to the trigger electrode 30 to ionize gas within the chamber 28. This ionization sharply lowers the impedance of the flash tube. This allows a flash-firing capacitor 35 to discharge through the flash tube, thereby producing a high intensity light flash.

When flash terminating circuitry (not shown) of the flash unit 34 determines that a sufficient amount of flash illumination has been produced, a flash terminating voltage is applied to the trigger electrode 32, thus ionizing gas in the chamber 26. This ionization sharply lowers the impedance of the quench tube. Because the two tubes are connected in parallel and the impedance of the quench tube is now much longer than the impedance of the flash tube, discharge current from the capacitor 35 now flows primarily through the quench tube. Insufficient current is available for maintaining the gas in the flash tube in its ionized state. Thus, the flash tube gas returns to its deionized state, and the light flash is terminated.

FIG. 5 illustrates the combined flash tube/quench apparatus of the invention in an energy-saving or series type quenchable electronic strobe flash unit 36. In this application of my invention, I use positive voltage pulses produced during one-half of each operating cycle of a DC to DC converter 40 to charge the flash-firing capacitor 35, and negative voltage pulses produced during the other one-half cycle of the converter 40 to charge a commutating capacitor 42.

As described regarding the operation of the strobe flash unit of FIG. 4, a flash tube trigger voltage applied to the trigger electrode 30 ionizes gas within the chamber 28. This causes a rapidly increasing voltage pulse, i.e. a high dv/dt, to appear at the anode of an SCR 44 which is serially connected between the cathode 18 and ground. The voltage pulse at the SCR's anode causes it to conduct, which allows the capacitor 35 to discharge through the flash tube and the SCR 44, thus producing light.

When the aforementioned flash terminating voltage is applied to the trigger electrode 32, the quench tube is caused to conduct. This causes the voltage across the commutating capacitor 42 to be immediately applied across the anode-cathode electrodes of the SCR 44. This voltage reverse biases the SCR 44, and thus turns it off. While the SCR 44 is reverse biased, discharge current from the capacitor 35 now flows through the flash tube and the quench tube to the commutating capacitor 42, which quickly becomes charged with a voltage opposite that which is shown in FIG. 5. This voltage raises the potential at the cathode electrode 18. When the difference between the voltage at the anode 24 and the voltage at the cathode 18 becomes less than a given voltage which is necessary to sustain ionization of gas in the flash tube, the gas returns to its deionized state, which terminates the light flash.

The invention has been described in detail with reference to the Figures, however, it will be appreciated that variations and modifications are possible within the spirit and scope of the invention. For example, it is not necessary that the portion of the envelope 12 which forms the quench tube, i.e., the tube 14, be light-transmitting, as any light produced by the quench tube is not necessary for a photographic flash exposure.

What is claimed is:

1. In a flash discharge apparatus including a light-transmitting envelope, and first and second electrodes disposed respectively at the ends of said envelope, the improvement comprising:

separating means including an intermediate electrode disposed within said envelope between said first and second electrodes for forming (1) a first enclosed chamber containing ionizable gas between said first electrode and said intermediate electrode, and (2) a second enclosed chamber containing ionizable gas between said second electrode and said intermediate electrode, said gas in said first and said second chambers being selected and pressurized respectively to provide a lower impedance for the arc discharge path within said second chamber than the impedance within said first chamber during operation of said discharge apparatus.

2. Discharge apparatus as defined in claim 1 wherein: said envelope comprises first and second sections sealed about said intermediate electrode.

3. In discharge apparatus including an envelope at least a portion of which is light-transmitting and having an ionizable gas contained therewithin, and first and second electrodes disposed respectively at the ends of said envelope, the improvement wherein:

an intermediate electrode is disposed within said envelope between said first and second electrodes to form (1) a first enclosed chamber containing ionizable gas between said first electrode and said intermediate electrode, and (2) a second enclosed chamber containing ionizable gas between said second electrode and said intermediate electrode, said intermediate electrode being located closer to said second electrode than to said first electrode to establish an impedance for the arc discharge path within said second chamber that is lower than the impedance for the arc discharge path within said first chamber during operation of said discharge apparatus when said intermediate electrode is of the opposite polarity of said first and second electrodes.

4. In discharge apparatus including an envelope at least a portion of which is light-transmitting and having an ionizable gas contained therewithin, and first and second electrodes respectively at the ends of said electrode, the improvement comprising:

an intermediate electrode disposed within said envelope between said first and second electrodes to form (1) a first enclosed chamber containing ionizable gas at a first pressure between said first electrode and said intermediate electrode, and (2) a second enclosed chamber containing ionizable gas at a second pressure between said second electrode and said intermediate electrode, said intermediate electrode being located closer to said second electrode than to said first electrode to establish an impedance for the arc discharge path within said second chamber that is lower than the impedance for the arc discharge path within said first chamber during operation of said discharge apparatus when the polarity of said intermediate electrode is opposite the polarity of said first and second electrodes.

5. In discharge apparatus including an envelope at least a portion of which is light-transmitting and having an ionizable gas contained therewithin, and first and second electrodes disposed respectively at the ends of said envelope, the improvement comprising:

(a) an intermediate electrode disposed within said envelope between said first and second electrodes to form (1) a first enclosed chamber containing ionizable gas at a first pressure between said first electrode and said intermediate electrode, and (2) a second enclosed chamber containing ionizable gas at a second pressure between said second electrode and said intermediate electrode, the second pressure being lower than the first pressure to establish an impedance for the arc discharge path within said second chamber that is less than the impedance for the arc discharge path within said first chamber during operation of said discharge apparatus when the polarity of said intermediate electrode is opposite the polarity of said first and second electrodes; and (b) trigger means connected for sequentially ionizing gas within said first and second chambers, to thereby sequentially establish separate arc discharge paths respectively through said first and second chambers.

6. In discharge apparatus for use in electronic strobe flash apparatus of the type having a first discharge device for producing light, and a second discharge device arranged to cause termination of the operating of the first device in response to the operating of the second device, said discharge apparatus including a light-transmitting envelope having an ionizable gas contained therewithin, and first and second electrodes disposed respectively at the ends of said envelope, the improvement comprising:

(a) an intermediate electrode disposed within said envelope between said first and second electrodes to form (1) a first discharge device containing ionizable gas between said first electrode and said intermediate electrode, and (2) a second discharge device containing ionizable gas between said second electrode and said intermediate electrode, said intermediate electrode being located closer to said second electrode than to said first electrode to establish an impedance for an arc discharge path of said second discharge device during its operation that is low compared to the impedance of an arc discharge path of said first discharge device during its operation when the polarity of said intermediate electrode is opposite the polarity of said first and second electrodes; and (b) first and second trigger means for sequentially operating respectively said first and second discharge devices, to thereby sequentially establish separate arc discharge paths respectfully through said first and second discharge devices.

* * * * *

UNITED STATES PATENT OFFICE

CERTIFICATE OF CORRECTION

PATENT NO. : 4,415,840

DATED : November 15, 1983

INVENTOR(S) : Hans P. A. Baumeister

It is certified that error appears in the above-identified patent and that said Letters Patent are hereby corrected as shown below:

Column 3, line 28, delete "an" and insert --my-- in its place.

Column 4, line 18, delete "16" and insert --26-- in its place.

Column 4, line 51, insert --tube-- before "apparatus".

Signed and Sealed this

*Twenty-eighth* Day of *February 1984*

[SEAL]

*Attest:*

GERALD J. MOSSINGHOFF

*Attesting Officer*

*Commissioner of Patents and Trademarks*